US009439512B2

(12) United States Patent
Miller et al.

(10) Patent No.: US 9,439,512 B2
(45) Date of Patent: Sep. 13, 2016

(54) GROW-WITH-ME EASEL APPARATUS

(71) Applicant: Crayola LLC, Easton, PA (US)

(72) Inventors: Elizabeth Miller, Bethlehem, PA (US); Anthony P. Monzo, Easton, PA (US)

(73) Assignee: L & P Property Management Company, South Gate, CA (US)

( * ) Notice: Subject to any disclaimer, the term of this patent is extended or adjusted under 35 U.S.C. 154(b) by 0 days.

(21) Appl. No.: 14/044,451

(22) Filed: Oct. 2, 2013

(65) Prior Publication Data

US 2014/0091194 A1 Apr. 3, 2014

Related U.S. Application Data

(60) Provisional application No. 61/708,887, filed on Oct. 2, 2012.

(51) Int. Cl.
*A47B 97/04* (2006.01)
*A47B 97/08* (2006.01)

(52) U.S. Cl.
CPC ..... *A47B 97/08* (2013.01); *A47B 97/04* (2013.01)

(58) Field of Classification Search
CPC ..... A47B 97/02; A47B 97/04; A47B 97/06; A47B 97/08
USPC ..... 248/441.1, 454, 455, 458, 460, 463, 248/464, 166; 40/120, 610, 661.06, 723, 40/724; 434/408, 413, 414, 418, 419, 420; D6/300, 312
See application file for complete search history.

(56) References Cited

U.S. PATENT DOCUMENTS 493,134 A * 3/1893 Utter ..... A47B 25/00 312/230
752,990 A * 2/1904 Miller ..... 312/230
778,950 A * 1/1905 Cannon ..... 312/230
3,007,269 A * 11/1961 Jump ..... 40/610
3,087,701 A * 4/1963 Wallace ..... 248/166
3,297,118 A * 1/1967 Skyhawk ..... A45C 9/00 190/1
3,952,989 A * 4/1976 Bannister ..... 248/453
4,005,537 A * 2/1977 von Camber ..... E01F 13/02 40/606.19
4,036,465 A * 7/1977 Kellner ..... 248/463
4,168,573 A * 9/1979 Chase ..... 33/1 K
4,834,334 A * 5/1989 Robins ..... 248/441.1
4,875,302 A * 10/1989 Noffsinger ..... G09F 15/0062 248/150
5,095,642 A * 3/1992 George ..... G09F 15/0062 40/610
5,273,248 A * 12/1993 Grander ..... A47B 85/00 211/2
5,305,114 A * 4/1994 Egashira et al. ..... 358/401
5,542,640 A * 8/1996 Tarozzi ..... 248/460
(Continued)

*Primary Examiner* — Jonathan Liu
*Assistant Examiner* — Guang H Guan
(74) *Attorney, Agent, or Firm* — Shook, Hardy & Bacon, L.L.P.

(57) ABSTRACT

An adjustable easel for configuring into multiple positions is described. The adjustable easel includes a work surface, an accessory tray, and a frame having a first and second pair of frame members that are selectively adjustable into a plurality of positions. The plurality of positions includes a first position, where the accessory tray and the plurality of frame members are configured to provide a portable storage case. In a second position, a first work surface is secured relative to the frame members, with the first pair of frame members positioned at a distance from the second pair of frame members. In a third position, a second work surface is secured relative to the frame members. A work surface support, coupled to the first and second work surfaces, is pivoted about a longitudinal axis of the frame when adjusting the position of the adjustable easel.

15 Claims, 4 Drawing Sheets

(56) References Cited

U.S. PATENT DOCUMENTS 5,713,552 A * 2/1998 Diamant ..... 248/460
5,794,540 A * 8/1998 Dombrowski ..... A47B 97/04 108/11
6,332,824 B2 * 12/2001 Tell ..... 446/143
7,128,367 B2 * 10/2006 You ..... A47D 1/02 297/344.1
7,866,074 B2 * 1/2011 McComb et al. ..... 40/606.01
2014/0015388 A1 * 1/2014 Diamant ..... B29C 45/14065 312/230
2014/0091194 A1 * 4/2014 Miller ..... A47B 97/08 248/457

* cited by examiner

GROW-WITH-ME EASEL APPARATUS

CROSS-REFERENCE TO RELATED APPLICATIONS

This application claims priority to U.S. Provisional Application Ser. No. 61/708,887, filed Oct. 2, 2012, entitled "Grow-With-Me Easel Apparatus," the disclosure of which is hereby incorporated by reference in its entirety.

SUMMARY

Embodiments of the invention are defined by the claims below, not this summary. A high-level overview of various aspects of the invention are provided here for that reason, to provide an overview of the disclosure, and to introduce a selection of concepts that are further described in the Detailed-Description section below. This summary is not intended to identify key features or essential features of the claimed subject matter, nor is it intended to be used as an aid in isolation to determine the scope of the claimed subject matter. In brief and at a high level, this disclosure describes, among other things, an adjustable easel for supporting a work surface, with the easel being adjustable between an enclosed position, an expanded position, and a standing position. As such, the apparatus serves as a carrying case for at least the work surface when in the enclosed position. Further, the adjustable easel may be configured as a floor-level easel when in the expanded position, such that a seated user may access the work surface. In a further embodiment, the adjustable easel may be configured into an upright and/or standing position for a standing user. Accordingly, the adjustable easel can "grow" with the user as they move from requiring a seated easel drawing surface, to requiring a standing easel drawing surface.

DESCRIPTION OF THE DRAWINGS

Illustrative embodiments of the invention are described in detail below with reference to the attached drawing figures, and wherein.

DETAILED DESCRIPTION

Figure 1:
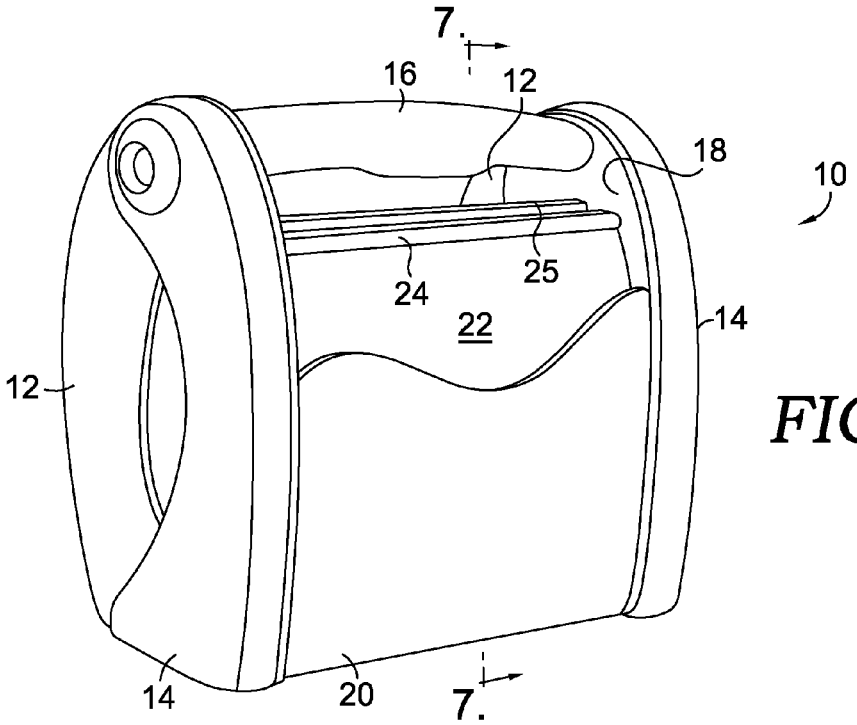
FIG. 1 is a side perspective view of an adjustable easel arranged in a first, enclosed position, in accordance with an embodiment of the invention.

The subject matter of select embodiments of the invention is described with specificity herein to meet statutory requirements. But the description itself is not intended to necessarily limit the scope of claims. Rather, the claimed subject matter might be embodied in other ways to include different components, steps, or combinations thereof similar to the ones described in this document, in conjunction with other present or future technologies. Terms should not be interpreted as implying any particular order among or between various steps herein disclosed unless and except when the order of individual steps is explicitly described.

Embodiments of the invention include an easel support structure for providing a work surface in a variety of configurations, such as varying heights. In embodiments, the easel is configured in a first position, such as an enclosed and/or collapsed position, with the frame members folded into the body of the easel frame. In the first position, the opposing pairs of frame members, such as the legs of the easel, are folded into a stationary position adjacent each other, based on rotation about a longitudinal axis of the easel frame. A work surface support structure is also adapted for pivoting about the longitudinal axis, such as during the positioning of the work surface with respect to each configuration of the easel.

In embodiments where the easel is configured in the first position, an accessory tray may be coupled to a lower, lateral edge of the work surface. Accordingly, the accessory tray may be pivoted at the point of attachment into a generally upright position that creates an enclosed, "carrying case" portion of the easel using the enclosed space between the work surface and the accessory tray. For example, a user may store drawing devices, such as markers, pens, pencils, crayons, etc., in at least one cavity formed between the accessory tray and the work surface when the accessory tray is pivoted into a position adjacent the work surface. In one embodiment, the accessory tray "clips" into engagement adjacent the body of the easel frame, the frame members, and/or the work surface. In another embodiment, a surface of the accessory tray is configured to retain one or more drawing devices. For example, a plurality of retaining features (e.g., clips) on a surface of the accessory tray may be used to retain markers, pens, pencils, crayons, etc., for drawing on the work surface, and storage within the adjustable easel in the first position.

In another embodiment, with the adjustable easel in the first position, the work surface may be accessed for use as a writing surface in a collapsed position. For example, the accessory tray may be pivoted away and/or removed from the work surface such that the work surface is accessible as a "lap desk." In one embodiment, both a first work surface and a second work surface (directly opposite the first work surface) may be alternately accessed in the first position as two separate "lap desk" writing surfaces. For example, upon collapsing the adjustable easel into the first position, opposing sides of the adjustable easel are accessible as alternate drawing surfaces. In another embodiment, while a first work surface is coupled to an accessory tray, thereby forming an enclosed cavity (i.e., "carrying case") portion of the adjustable easel, the opposing second work surface may be accessed by a user for writing when in the collapsed first position. In a further embodiment, in the collapsed first position, the adjustable easel is enclosed within the body of the easel such that neither the first work surface nor the second work surface is accessible by a user. As such, a user's artwork may remain contained and/or protected for storage and/or travel, in one embodiment, within the collapsed adjustable easel in the first position.

In further embodiments, a handle of the easel may also be aligned along the longitudinal axis of the frame. The handle may be used to transport the collapsed easel when in the first position. Additionally, the pairs of frame members and the work surface support (that includes the work surfaces for multiple positions of the easel), may also be coupled, directly or indirectly, to the easel handle. As such, in one embodiment, both pairs of frame members are rotatably coupled to the adjustable easel, and are configured to move between a plurality of positions. For example, both the first pair of frame members and the second pair of frame members may pivot with respect to the longitudinal axis of the frame and/or handle to adjust an amount of space between the opposing pairs of frame members. In another embodiment, a first pair of frame members is coupled to the adjustable easel in a repositionable and/or rotatable position while a second pair of frame members and the handle remain in a stationary position. In yet another embodiment, the first pair of frame members remains stationary while the second pair of frame members is rotatable to adjust an amount of space between the first and second pairs of frame members.

Accordingly, embodiments of the adjustable easel may be expanded from the first position into a second position. In the second position, the pairs of frame members are spaced apart at one end, and are adjoining at the other, such that the frame provides a free-standing easel structure. As discussed above, in one embodiment, the first pair of frame members is pivotable with respect to the adjustable easel, while in another embodiment, the second pair of frame members is pivotable with respect to the adjustable easel. In another embodiment, both pairs of frame members may be pivoted about the longitudinal axis of the adjustable easel frame body. During expanding from the first position to the second position, In some embodiments, at least one of the pair of frame members includes at least one travel stopper that limits the distance the easel structure can travel along a surface when force is applied to the adjustable easel. For example, a pair of frame members may be coupled to a corresponding pair of travel stoppers that prevent the adjustable easel from traveling across the ground when a user is writing on the first work surface, with the adjustable easel in the second position.

In the second position, a first work surface is displayed to a front side of the adjustable easel. In embodiments, the first work surface is any surface configured to support a user work piece, such as a drawing, painting, etc. For example, the first work surface may be a wipe-away surface for use with dry-erase markers. In another example, the first work surface includes one or more clipping structures to attach a piece of paper or other marking surface to the first work surface. In a further embodiment, the first work surface may be a magnetic surface for coupling one or more magnetic pieces to the first work surface. In another embodiment, the first work surface may be a chalkboard surface for use with chalk writing devices. In further embodiments, the first work surface includes a plurality of drawing sheets of paper, or other removable writing surfaces, which are coupled to a background surface that supports the drawing sheets.

In further embodiments, when the adjustable easel is in the second position, the accessory tray may be pivoted away from the first work surface such that the first work surface is accessible to the user. For example, the accessory tray may be pivoted down into a horizontal position, thereby making the accessories (e.g., marking instruments such as markers, pens, pencils, crayons, etc.) that were previously enclosed in the first position, accessible by a user. As such, in the second position, a user may position the first and second pairs of frame members apart from each other, resting each frame member on a solid surface. As such, the accessory tray may be pivoted into a position parallel to the plane of the surface(s) supporting the frame members (e.g., adjacent surfaces in substantially the same plane), while remaining coupled to at least a portion of the adjustable easel.

In a further embodiment, the adjustable easel may be configured into a third position, with a second work surface positioned so that a standing user may access the second work surface. As such, the second work surface is displayed to the front side of the adjustable easel. In embodiments, the accessory tray is coupled to a lateral edge of the second work surface. Accordingly, the accessory tray is moveable from the lateral edge of the first work surface (e.g., the bottom edge of the first work surface when the first work surface faces the front side of the adjustable easel), to a lateral edge of the second work surface (e.g., the bottom edge of the second work surface when the second work surface faces the front side of the adjustable easel). For example, a user may remove the accessory tray from the adjustable easel in the second position, pivot the adjustable easel into the third position, and re-attach the accessory tray to the second work surface. In one embodiment, while the accessory tray was positioned in the plane parallel to the surface supporting the adjustable easel (i.e., the "feet" of the frame members) in the first position, once re-attached to the second work surface, the accessory tray may be positioned in a plane substantially parallel to the surface supporting the frame members (e.g., parallel to the floor). Further, in some embodiments, pivoting of the work surface support determines the overall orientation of the adjustable easel.

Accordingly, in one embodiment, an adjustable easel is provided. The adjustable easel comprises a first work surface; a second work surface; an accessory tray; and a frame having a plurality of frame members selectively coupled to one another, wherein the plurality of frame members comprises a first pair of frame members and a second pair of frame members, wherein the plurality of frame members are selectively adjustable into each of a plurality of positions, wherein the plurality of positions comprises: a first position, wherein the adjustable easel is configured to provide a portable storage case in the first position; a second position, wherein the adjustable easel is configured to position the first work surface in the second position, wherein the first work surface is secured relative to the frame members; and a third position, wherein the adjustable easel is configured to position the second work surface in the third position, wherein the second work surface is secured relative to the frame members.

In another embodiment, the adjustable easel comprises at least two work surfaces; an accessory tray; and a frame having a plurality of frame members selectively coupled to one another, wherein the plurality of frame members comprises a first pair of frame members and a second pair of frame members, wherein the plurality of frame members are selectively adjustable into a plurality of positions comprising: a first position, wherein the accessory tray and the plurality of frame members are configured to provide a portable storage case, and further wherein the accessory tray is coupled to a first lateral edge of the first work surface and is pivoted into a stationary position such that longitudinal edges of the accessory tray are adjacent an interior surface of the second pair of frame members, and the first pair of frame members is collapsed against the second pair of frame members such that both ends of the first and second pairs of frame members are directly adjacent each other; a second position, wherein the first work surface is secured relative to the frame members, and further wherein a first end of the first pair of frame members positioned at a distance from a first end of the second pair of frame members, and a second end of the first pair of frame members and a second end of the second pair of frame members are positioned directly adjacent each other along a longitudinal axis of the frame, wherein the accessory tray is coupled to the first lateral edge of the first work surface and is pivoted into a horizontal position; and a third position, wherein a second work surface is secured relative to the frame members, and further wherein the first end of the first pair of frame members is positioned at a distance from the first end of the second pair of frame members, wherein the second end of the first pair of frame members and the second end of the second pair of frame members are positioned directly adjacent each other along the longitudinal axis of the frame, wherein the accessory tray is coupled to the second lateral edge of the second work surface and pivoted into a horizontal position.

In a further embodiment, an adjustable easel comprises: an accessory tray; a frame comprising a first pair of frame members and a second pair of frame members; a handle oriented along a longitudinal axis of the frame; a work surface having a first side and a second side; and a work surface support coupled to the work surface, wherein the accessory tray, the first pair of frame members, the second pair of frame members, and the work surface support are pivotable around the longitudinal axis of the frame, and further wherein the adjustable easel is adjustable between three positions, wherein the three positions comprise a first enclosed position, a second expanded position, and a third standing position.

With reference now to the figures, an apparatus for providing an adjustable easel is described in accordance with embodiments of the invention. Various embodiments are described with respect to the figures in which like elements are depicted with like numerals.

Figure 7:
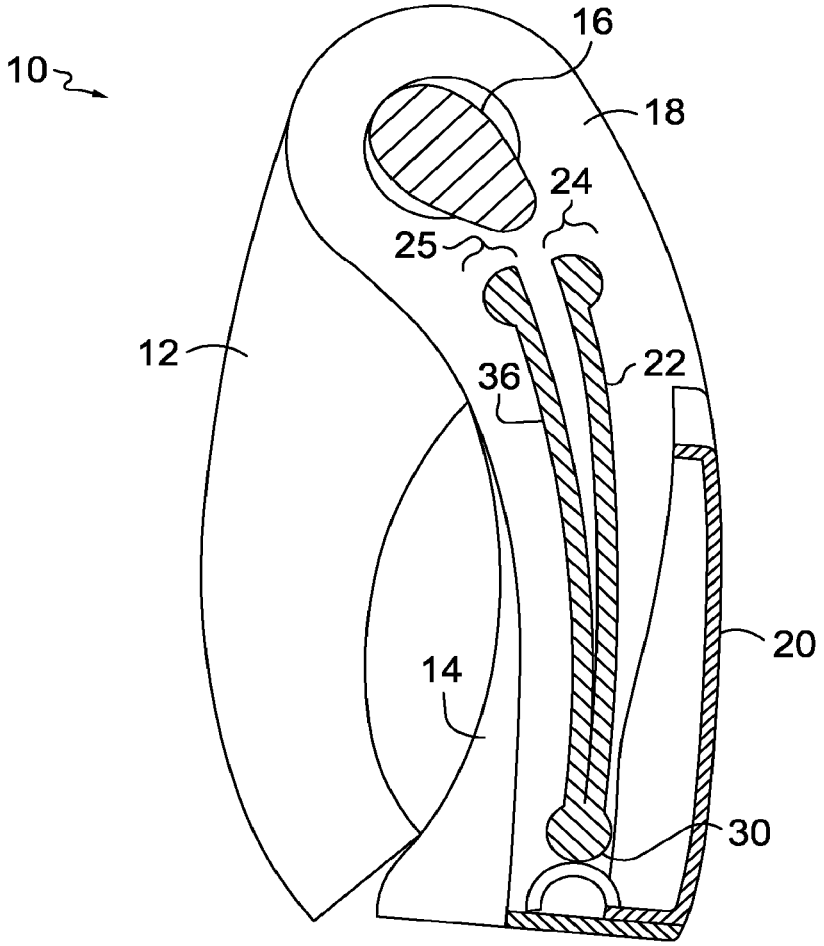
FIG. 7 is a side perspective view of the adjustable easel of FIG. 1, in accordance with an embodiment of the invention.

As depicted in FIG. 1, embodiments of the invention include an adjustable easel 10 having a first pair of frame members 12, a second pair of frame members 14, a handle 16, a work surface support 18, an accessory tray 20, a first work surface 22, and a second lateral edge 24. In embodiments, the first pair of frame members 12 may be collapsed against the second pair of frame members 14 such that both ends of the frame member pairs are adjacent (as further depicted in the FIG. 7 side view, with the accessory tray 20 folded so that it is positioned adjacent the first work surface 22, the first work surface 22 is positioned between the second lateral edge 24 and the first lateral edge 30, while the second work surface 36 is positioned between the third lateral edge 25 and the first lateral edge 30). Such a configuration, as depicted in FIG. 1, may be referred to as a "first position," where the adjustable easel 10 is in a portable configuration. As such, an exemplary adjustable easel 10 may be configured in the first position for carrying by the handle 16, and for storage of accessories inside the space created between the accessory tray 20 and the first work surface 22. Further, the adjustable easel 10 may stand upright when in the first position. In further embodiments, when in the first position, at least a portion of the first work surface 22 is protected for storage and/or travel.

Figure 2:
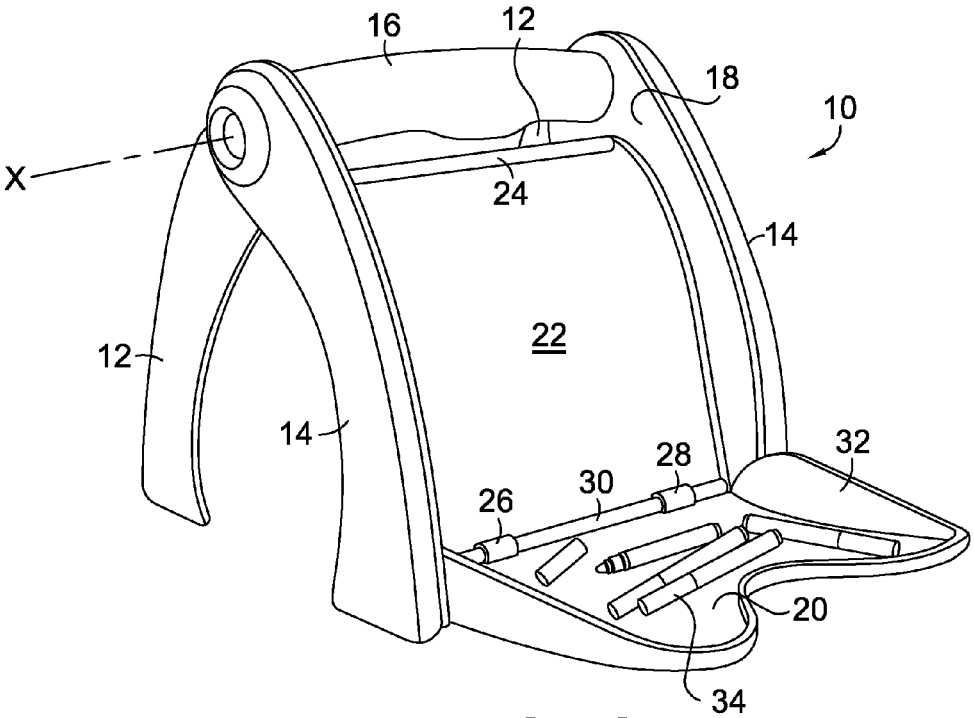
FIG. 2 is side perspective view of the adjustable easel of FIG. 1, with the frame members in a second, expanded position and the accessory tray coupled to a lateral edge of the work surface, in accordance with an embodiment of the invention.

In FIG. 2, the adjustable easel 10 is configured in an expanded position, which may be referred to as a "second position." In addition to the features described with respect to FIG. 1, the expanded view of FIG. 2 includes a longitudinal axis X, a first lateral edge 30, attachment points 26 and 28, and accessory tray surface 32. In the second position, the first pair of frame members 12 is expanded away from a portion of the second pair of frame members 14. For example, in the first position (collapsed) the first and second pairs of frame members 12 and 14 are positioned a first distance apart (e.g., directly adjacent), while in a second position (expanded) the first and second pairs of frame members 12 and 14 are positioned a second distance apart (e.g., a predetermined distance apart and/or an amount of space determined by the user, with the second distance being greater than the first distance). In embodiments, the second distance is an adjusted distance for positioning and/or configuring the adjustable easel 10, such that the writing surface may be marked on without the adjustable easel 10 collapsing. Accordingly, while both ends of the frame members were adjoining in the first position of FIG. 1, only one end of the pairs of frame members is directly adjacent in the second position of FIG. 2. As shown in FIG. 2, the positioning of the first pair of frame members 12, the second pair of frame members 14, and the work support surface 18, configures the adjustable easel 10 such that the first work surface 22 is positioned in a generally upright position.

In the embodiment of FIG. 2, accessory tray 20 is pivoted away from the first work surface 22, and positioned generally horizontally, as coupled to the first lateral edge 30 of first work surface 22 using attachment points 26 and 28. As will be understood, any number of types of attachment mechanisms may be used to attach the accessory tray 20 to the first lateral edge 30 of the first work surface 22, including attachment points 26 and 28. In embodiments, the first lateral edge 30 is a ridge and/or raised edge adjacent the first work surface 22 where one or more features of the adjustable easel 10 may be attached. For example, an accessory tray 20 may couple to the first lateral edge 30 using one or more attachment points 26 and 28. In further embodiments, additional features, such as tool-holding devices, erasers, etc., may also be coupled to the first lateral edge 30. Further, as shown in FIG. 2, embodiments of the accessory tray 20 include an accessory tray surface 32 that is configured to enclose one or more drawing tools inside a cavity created between the accessory tray 20 and the first work surface 22. As such, accessory tray surface 32 may include an edge and/or "lip" around a perimeter of the accessory tray 20 that creates a storage cavity between the accessory tray 20 and the first work surface 22 when the accessory tray 20 is pivoted into a position adjacent the first work surface 22.

In embodiments, the first work surface 22 is a wipe-away surface, such as a dry-erase board, where markers 34 may be used to write on the first work surface 22. In some embodiments, a clip or clamping device may be coupled to an edge of the first work surface 22 to secure an additional writing surface to the adjustable easel 10, such as a piece of paper. Accordingly, second lateral edge 24 may include an attachment features for coupling one or more drawing sheets to the first drawing surface 22. In one embodiment, second lateral edge 24 includes a clipping feature for attaching a drawing sheet to the first work surface 22 of the adjustable easel 10.

Figure 3:
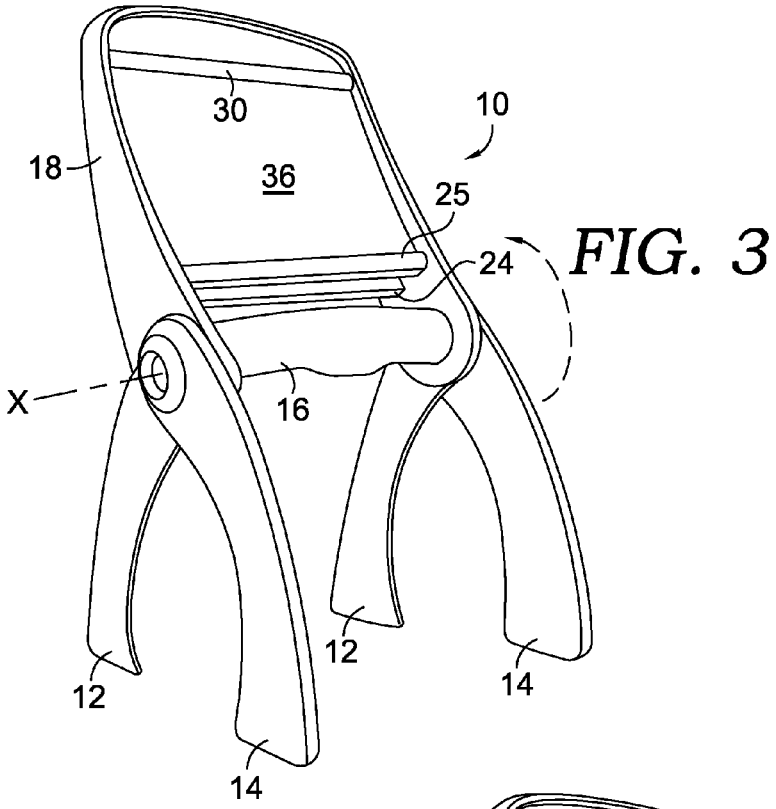
FIG. 3 is a side perspective view of the adjustable easel of FIG. 1, with the frame members in a third, expanded position and a work surface support in an extended position, in accordance with an embodiment of the invention.

In FIG. 3, the accessory tray 20 has been removed and work surface support 18 is pivoted into an upright position, with the sides of work surface support 18 no longer adjacent to the interior of the second pair of frame members 14. Accordingly, the embodiment of FIG. 3 may be referred to as a "third position," having the work surface support 18 pivoted about the longitudinal axis X, to reveal a second work surface 36. As such, the second work surface 36 now faces the front side of the adjustable easel 10, as depicted in the perspective view of FIG. 3. In embodiments, having rotated the work support surface 18, and the corresponding first and second work surfaces 22 and 36 into an upright position, the user of the adjustable easel 10 may now access the second work surface 36 from a standing position. In embodiments, while the first lateral edge 30 defined a bottom edge of the first work surface 22 and the second lateral edge 24 defined a top edge of the first work surface 22 when the adjustable easel 10 was in the second position (FIG. 2), upon rotation of the work support surface 18, a third lateral edge 25 defines a bottom edge of the second work surface 36 and the first lateral edge 30 defines a top edge of the second work surface 36 when in the third position (FIG. 3). In embodiments, in the second position or the third position, the work support surface 18 and corresponding first and second work surfaces 22 and 36 are secured relative to the frame members of the adjustable easel 10 such that first and second work surfaces 22 and 36 are stationary drawing surfaces for a user to mark upon.

In some embodiments, a clip or clamping device may be coupled to an edge of the second work surface 36 to secure an additional writing surface to the adjustable easel 10, such as a piece of paper. Accordingly, first lateral edge 30 may include an attachment features for coupling one or more drawing sheets to the second drawing surface 36. In one embodiment, first lateral edge 30 includes a clipping feature for attaching a drawing sheet to the second work surface 36 of the adjustable easel 10.

Figure 4:
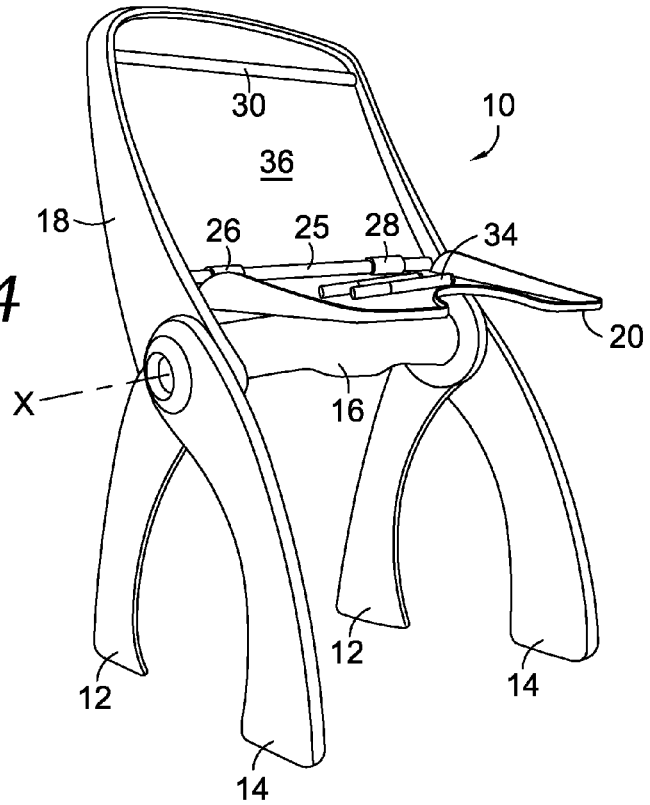
FIG. 4 is a side perspective view of the adjustable easel of FIG. 3, with the accessory tray coupled to a lateral edge of the second work surface, in accordance with an embodiment of the invention.

As shown in the embodiment of FIG. 4, the accessory tray 20 may be coupled to the third lateral edge 25 of the second work surface 36 using attachment points 26 and 28. In other words, in embodiments, the accessory tray 20 may be selectively attached to the first lateral edge 30 and/or the third lateral edge 25, using attachment points 26 and 28, and may therefore serve as an accessory tray 20 for use with either the first work surface 22 or the second work surface 36. In one example, based on attachment to the second lateral edge 24, the accessory tray 20 may be positioned generally horizontally for holding accessories (e.g., markers 34, crayons, pens, pencils, paintbrushes, etc.) for use with the adjustable easel 10.

Figure 5:
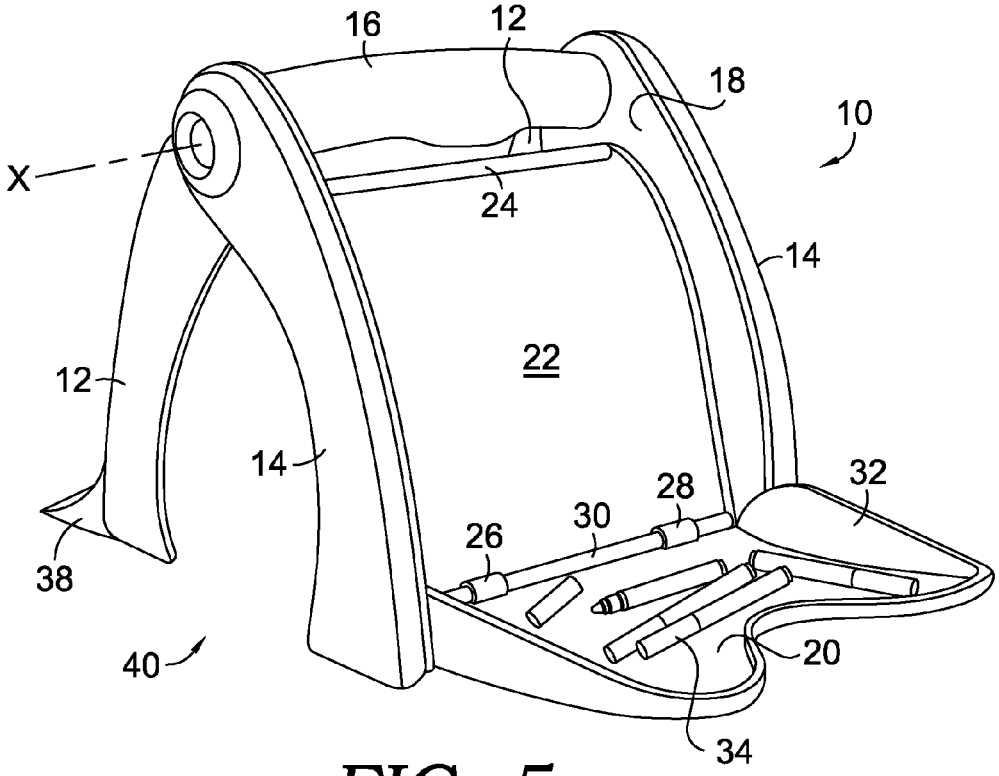
FIG. 5 is a side perspective view of the adjustable easel of FIG. 2, with a travel stopper coupled to a pair of frame members, in accordance with an embodiment of the invention.

In the embodiment of FIG. 5, the adjustable easel 10 of FIG. 2 is depicted with a pair of travel stoppers 38 coupled to the first pair of frame members 12. In embodiments, when a user pushes against the work surface 22, the adjustable easel 10 is prevented from sliding across a stationary surface by the friction created between the travel stoppers 38 and a supporting surface 40 (e.g., the floor). In another embodiment, travel stoppers 38 provide additional support to the adjustable easel 10 when in an upright position, such as the third position depicted in FIGS. 3-4. In some embodiments, travel stoppers 38 are removable, such that when the adjustable easel 10 is configured in the first position of FIG. 1, the first pair of frame members 12 may still abut an interior surface of the second pair of frame members 14. Further, in some embodiments, the collapsed easel 10 of the first position may still stand in an upright position, with or without the attachment of travel stoppers 38.

Figure 6:
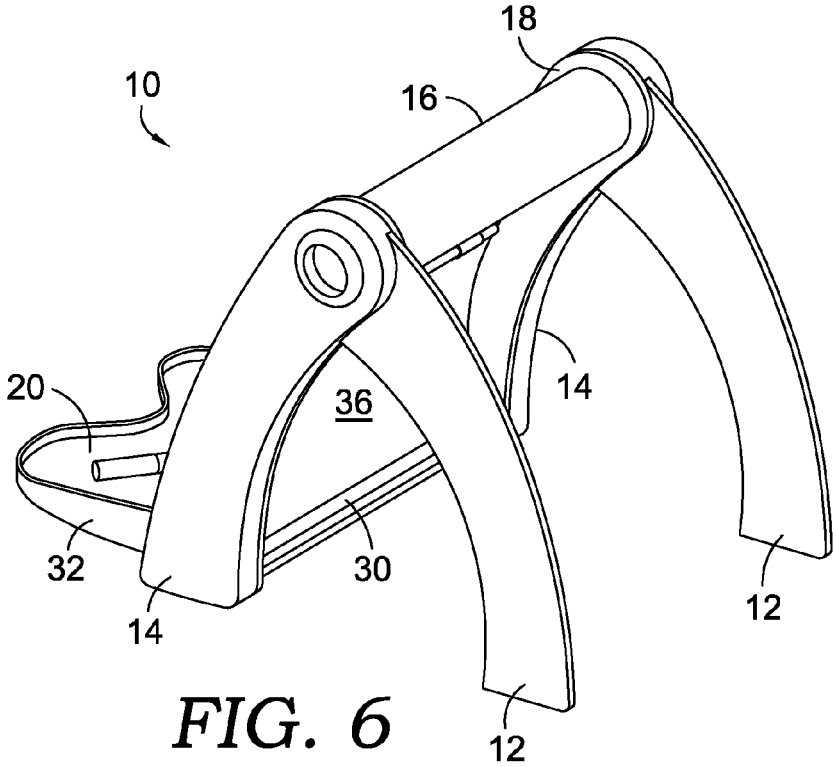
FIG. 6 is a rear perspective view of the adjustable easel of FIG. 2, in accordance with an embodiment of the invention.

Referring finally to FIG. 6, a rear view of the adjustable easel 10 of FIG. 2 is shown in the expanded, second position. As seen in the rear view of FIG. 6, the first pair of frame members 12 is expanded a particular distance away from a portion of the second pair of frame members 14. Accordingly, the positioning of the first pair of frame members 12, the second pair of frame members 14, and the work support surface 18, configures the adjustable easel 10 such that the second work surface 36 is positioned in a generally upright position.

Many different arrangements of the various components depicted, as well as components not shown, are possible without departing from the scope of the claims below. Embodiments of the technology have been described with the intent to be illustrative rather than restrictive. Alternative embodiments will become apparent to readers of this disclosure after and because of reading it. Alternative means of implementing the aforementioned can be completed without departing from the scope of the claims below. Certain features and subcombinations are of utility and may be employed without reference to other features and subcombinations and are contemplated within the scope of the claims.

The invention claimed is:

1. An adjustable easel comprising:

a work surface support having a pair of parallel spaced apart sidewalls, a first lateral edge, a second lateral edge, and a third lateral edge parallel with and spaced apart from the second lateral edge;

a first work surface directly connected to the first lateral edge and disposed between the pair of parallel spaced apart sidewalls, the first lateral edge, and the second lateral edge;

a second work surface opposite the first work surface and directly connected to the first lateral edge, the second work surface disposed between the pair of parallel spaced apart sidewalls, the first lateral edge, and the third lateral edge;

a frame having a plurality of frame members selectively coupled to one another, wherein the plurality of frame members comprises a first pair of frame members and a second pair of frame members, each frame member of the first pair of frame members having a first frame member distal end, a first frame member proximal end coupled to the work surface support near the second and third lateral edges of the work surface support, and a first frame member curved edge, each frame member of the second pair of frame members having a second frame member distal end, a second frame member proximal end coupled to the work surface support near the second and third lateral edges of the work surface support, and a second frame member curved edge opposite the first frame member curved edge of one of the first pair of frame members; and wherein the plurality of frame members is selectively adjustable into each of a plurality of positions, wherein the plurality of positions comprises:

(1) a first position, wherein for each frame member of the first pair of frame members: the first frame member distal end is positioned adjacent the second frame member distal end of one of the second pair of frame members, the first frame member proximal end is positioned adjacent the second frame member proximal end of the one of the second pair of frame members, and the first frame member curved edge is laterally spaced apart from the second frame member curved edge of the one of the second pair of frame members;

(2) a second position, wherein for each frame member of the first pair of frame members: the first frame member distal end is spaced apart from the second frame member distal end of the one of the second pair of frame members, and wherein the work surface support is secured relative to the plurality of frame members at a first elevation position; and (3) a third position, wherein the work surface support is secured relative to the plurality of frame members at a second elevation position, said second elevation position being higher than said first elevation position.

2. The adjustable easel of claim 1, wherein one or more of the first work surface and the second work surface is a wipe-away surface.

3. The adjustable easel of claim 1, further comprising an accessory tray, wherein the accessory tray is adapted to be coupled to the first lateral edge.

4. The adjustable easel of claim 3, wherein the accessory tray is coupled to the first lateral edge such that the accessory tray is pivotable between a vertical position and a horizontal position when the plurality of frame members is in the first position.

5. The adjustable easel of claim 4, wherein the accessory tray comprises at least two sidewalls, and when the accessory tray is pivoted into the vertical position, each of the at least two sidewalls of the accessory tray is adjacent an interior surface of the second pair of frame members.

6. The adjustable easel of claim 3, wherein the accessory tray is coupled to the first lateral edge such that the accessory tray is pivotable between a vertical position and a horizontal position when the plurality of frame members is in the second position.

7. The adjustable easel of claim 6, wherein the second position comprises:

the first work surface facing outward; and the accessory tray pivoted into the horizontal position.

8. The adjustable easel of claim 1, wherein an accessory tray is adapted to be coupled to the third lateral edge.

9. The adjustable easel of claim 8, wherein the accessory tray is coupled to the third lateral edge such that the accessory tray is pivotable between a vertical position and a horizontal position when the plurality of frame members is in the third position.

10. The adjustable easel of claim 9, wherein the third position comprises:

for each frame member of the first pair of frame members: the first frame member distal end is spaced apart from the second frame member distal end of the one of the second pair of frame members, and the first frame member proximal end is directly adjacent the second frame member proximal end of the one of the second pair of frame members at a longitudinal axis of the frame; and the second work surface facing outward.

11. The adjustable easel of claim 1, wherein the work surface support is adapted to pivot around a longitudinal axis of the frame.

12. An adjustable easel comprising:

a work surface support having a pair of parallel spaced apart sidewalls, a first lateral edge, a second lateral edge, and a third lateral edge parallel with and spaced apart from the second lateral edge;

at least two work surfaces comprising a first work surface and a second work surface opposite the first work surface, the first work surface directly connected to the first lateral edge and disposed between the pair of parallel spaced apart sidewalls, the first lateral edge, and the second lateral edge, and the second work surface directly connected to the first lateral edge and disposed between the pair of parallel spaced apart sidewalls, the first lateral edge, and the third lateral edge;

an accessory tray; and a frame having a plurality of frame members selectively coupled to one another, wherein the plurality of frame members comprises a first pair of frame members and a second pair of frame members, each frame member of the first pair of frame members having a first frame member distal end, a first frame member proximal end coupled to the work surface support near the second and third lateral edges of the work surface support, and a first frame member curved edge, each frame member of the second pair of frame members having a second frame member distal end, a second frame member proximal end coupled to the work surface support near the second and third lateral edges of the work surface support, and a second frame member curved edge opposite the first frame member curved edge of one of the first pair of frame members; and wherein the plurality of frame members is selectively adjustable into a plurality of positions comprising:

(1) a first position, wherein the accessory tray and the plurality of frame members are configured to provide a portable storage case, and wherein the accessory tray is coupled to the first lateral edge and is pivoted into a stationary position such that at least two sidewalls of the accessory tray each are adjacent an interior surface of the second pair of frame members, and further wherein for each frame member of the first pair of frame members: the first frame member distal end is positioned adjacent the second frame member distal end of one of the second pair of frame members, the first frame member proximal end is positioned adjacent the second frame member proximal end of the one of the second pair of frame members, and the first frame member curved edge is laterally spaced apart from the second frame member curved edge of the one of the second pair of frame members;

(2) a second position, wherein the work surface support is secured relative to the plurality of frame members at a first elevation position to be proximate a supporting surface for supporting the adjustable easel, and wherein for each frame member of the first pair of frame members: the first frame member distal end is spaced apart from the second frame member distal end of the one of the second pair of frame members, and the first frame member proximal end is directly adjacent the second frame member proximal end of the one of the second pair of frame members along a longitudinal axis of the frame, and further wherein the accessory tray is coupled to the first lateral edge and is pivoted into a horizontal position; and (3) a third position, wherein the work surface support is secured relative to the plurality of frame members at a second elevation position, said second elevation position higher than the first elevation position, and wherein for each frame member of the first pair of frame members: the first frame member distal end is spaced apart from the second frame member distal end of the one of the second pair of frame members, and the first frame member proximal end is directly adjacent the second frame member proximal end of the one of the second pair of frame members at the longitudinal axis of the frame, and further wherein the accessory tray is coupled to the third lateral edge and pivoted into the horizontal position.

13. The adjustable easel of claim 12, wherein the frame further includes a handle, and wherein the first pair of frame members and the second pair of frame members are coupled to the work surface support at the longitudinal axis of the frame, and wherein the work surface support is pivotable about the longitudinal axis of the frame.

14. The adjustable easel of claim 12, wherein the frame further includes a handle having a first end and a second end, and wherein the work surface support is coupled to the first end of the handle and the second end of the handle.

15. An adjustable easel comprising:

an accessory tray;

a work surface support having a pair of parallel spaced apart sidewalls, a first lateral edge, a second lateral edge, and a third lateral edge parallel with and spaced apart from the second lateral edge;

a frame comprising a first pair of frame members, a second pair of frame members, and a handle oriented along a longitudinal axis of the frame, each frame member of the first pair of frame members having a first frame member distal end, a first frame member proximal end coupled to the work surface support about the longitudinal axis of the frame, and a first frame member curved edge, each frame member of the second pair of frame members having a second frame member distal end, a second frame member proximal end coupled to the work surface support about the longitudinal axis of the frame, and a second frame member curved edge opposite the first frame member curved edge of one of the first pair of frame members; and at least two work surfaces comprising a first work surface and a second work surface opposite the first work surface, the first work surface directly connected to the first lateral edge and disposed between the pair of parallel spaced apart sidewalls, the first lateral edge, and the second lateral edge, and the second work surface directly connected to the first lateral edge and disposed between the pair of parallel spaced apart sidewalls, the first lateral edge, and the third lateral edge, wherein the accessory tray, the first pair of frame members, the second pair of frame members, and the work surface support are pivotable around the longitudinal axis of the frame, and further wherein the adjustable easel is adjustable between three positions, wherein the three positions comprise:

(1) a first enclosed position, wherein the accessory tray, the first pair of frame members, and the second pair of frame members are configured to provide a portable storage case, and wherein the accessory tray is coupled to the first lateral edge and is pivoted into a stationary position such that at least two sidewalls of the accessory tray each are adjacent an interior surface of the second pair of frame members, and further wherein for each frame member of the first pair of frame members: the first frame member distal end is positioned adjacent the second frame member distal end of one of the second pair of frame members, the first frame member proximal end is positioned adjacent the second frame member proximal end of the one of the second pair of frame members, and the first frame member curved edge is laterally spaced apart from the second frame member curved edge of the one of the second pair of frame members;

(2) a second expanded position, wherein the work surface support is secured relative to the plurality of frame members at a first elevation position, and wherein for each frame member of the first pair of frame members: the first frame member distal end is spaced apart from the second frame member distal end of the one of the second pair of frame members, and the first frame member proximal end is directly adjacent the second frame member proximal end of the one of the second pair of frame members along the longitudinal axis of the frame, and further wherein the accessory tray is coupled to the first lateral edge and is pivoted into a horizontal position, and (3) a third standing position, wherein the work surface support is secured relative to the plurality of frame members at a second elevation position, said second elevation position higher than the first elevation position, and wherein for each frame member of the first pair of frame members: the first frame member distal end is spaced apart from the second frame member distal end of the one of the second pair of frame members, and the first frame member proximal end is directly adjacent the second frame member proximal end of the one of the second pair of frame members along the longitudinal axis of the frame, and further wherein the accessory tray is coupled to the third lateral edge and pivoted into the horizontal position.

* * * * *